US007975761B2

(12) United States Patent
Berckenhoff et al.

(10) Patent No.: US 7,975,761 B2
(45) Date of Patent: Jul. 12, 2011

(54) METHOD AND DEVICE WITH BIASING FORCE FOR SEALING A WELL

(75) Inventors: Michael Wayne Berckenhoff, Spring, TX (US); Eugene Charles Chauviere, III, Cypress, TX (US); Dustin Dean Gass, Spring Branch, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 284 days.

(21) Appl. No.: 12/338,206

(22) Filed: Dec. 18, 2008

(65) Prior Publication Data

US 2010/0155086 A1 Jun. 24, 2010

(51) Int. Cl.
*E21B 33/06* (2006.01)

(52) U.S. Cl. ..... 166/85.4; 251/1.3

(58) Field of Classification Search ..... 166/298, 166/379, 55, 85.4; 251/1.3
See application file for complete search history.

(56) References Cited

U.S. PATENT DOCUMENTS

| | | | | |
|---|---|---|---|---|
| 1,713,364 | A | 5/1929 | Arbon | |
| 3,791,616 | A | 2/1974 | Le Rouax | |
| 4,192,483 | A | 3/1980 | Combes | |
| 4,240,642 | A | 12/1980 | Roussin | |
| 4,364,544 | A | 12/1982 | Kim | |
| 4,392,657 | A | 7/1983 | Roley | |
| 4,444,404 | A | 4/1984 | Parks, Jr. | |
| 4,572,298 | A | 2/1986 | Weston | |
| 5,320,327 | A | 6/1994 | Beson | |
| 6,164,619 | A | 12/2000 | Van Winkle et al. | |
| 6,554,247 | B2 * | 4/2003 | Berckenhoff et al. | 251/1.3 |
| 6,719,042 | B2 * | 4/2004 | Johnson et al. | 166/55 |
| 6,955,357 | B2 * | 10/2005 | Griffin et al. | 277/325 |
| 7,234,530 | B2 * | 6/2007 | Gass | 166/376 |
| 7,703,739 | B2 * | 4/2010 | Judge et al. | 251/1.3 |
| 7,717,170 | B2 * | 5/2010 | Williams | 166/84.3 |
| 2008/0135791 | A1 * | 6/2008 | Juda et al. | 251/1.3 |

FOREIGN PATENT DOCUMENTS

WO 2008/073874 6/2008

OTHER PUBLICATIONS

Office Action issued in related U.S. Appl. No. 11/609,585, mailed on Jun. 1, 2009.

* cited by examiner

*Primary Examiner* — Kenneth Thompson
*Assistant Examiner* — Sonya Bible
(74) *Attorney, Agent, or Firm* — Potomac Patent Group PLLC

(57) ABSTRACT

Methods and devices with biasing force for sealing a well. Such a device is a blowout preventer has a body including a cavity having first and second recesses, a ram block configured to move inside the cavity, a top seat provided in the first recess and configured to seal the well when the ram block is closed, a wear plate provided in the second recess and configured to contact the ram block when the ram block moves inside the cavity over the wear plate, and a biasing element provided inside the cavity and configured to apply a biasing force on at least one of the top seat, the ram block or the wear plate to increase the sealing of the well.

23 Claims, 16 Drawing Sheets

METHOD AND DEVICE WITH BIASING FORCE FOR SEALING A WELL

BACKGROUND

1. Technical Field

Embodiments of the subject matter disclosed herein generally relate to methods and devices and, more particularly, to mechanisms and techniques for providing biasing forces to various parts of an apparatus for sealing a well.

2. Discussion of the Background

One apparatus for sealing a well is a blowout preventer (BOP). BOP is a safety mechanism that is used at a wellhead of an oil or gas well. The BOP may be used for offshore drilling (surface or subsea) and also for land-based drilling. The BOP is configured to shut the flow from the well when certain events occur. One such event may be the uncontrolled flow of gas, oil or other well fluids from an underground formation into the well. Such event is sometimes referred to as a "kick" or a "blowout" and may occur when formation pressure exceeds the pressure generated by the column of drilling fluid. This event is unforeseeable and if no measures are taken to prevent it, the well and/or the associated equipment may be damaged.

Thus, it is desirable that the BOP does not malfunction. One case when the BOP may malfunction is when parts of the BOP are worn and thus, they fail to properly maintain the pressure in the well. The wear process may occur, for example, at the packers attached to the ram blocks of the BOP. When a blowout occurs and the packers are worn, the BOP may fail to properly seal the well, resulting in, for example, damage to the BOP and/or other equipment attached to the well. Therefore, the wear state of the parts of the BOP should be monitored and the worn parts should be replaced to prevent the failure of the BOP. Other events that may damage the integrity of the well and/or associated equipment are possible as would be appreciated by those skilled in the art.

The BOP may be installed on top of the well to seal the well in case that one of the above events is threatening the integrity of the well. The BOP is conventionally implemented as a valve to prevent the release of pressure either in the annular space between the casing and the drill pipe or in the open hole (i.e., hole with no drill pipe) during drilling or completion operations. However, in order to seal the well for a certain time, the elements of the BOP that achieve the seal should be able to maintain the sealing despite the normal wearing process that occurs due to repeated closing and opening of the BOP sealing elements.

One way to maintain the sealing of the BOP is to regularly inspect its components and change those that are worn. However, this process is time consuming, as the components of the BOP are difficult to access and/or inspect as they are undersea or in remote areas, and also expensive, as the operation of the rig has to be stopped.

FIG. 1 shows a well 10. A wellhead 12 of the well 10 may be fixed to the seabed 14. The BOP 16 is secured to the wellhead 12. FIG. 1 shows, for clarity, the BOP 16 detached from the wellhead 12. However, the BOP 16 is attached to the wellhead 12 or other part of the well. A pipe 18 is shown traversing the BOP 16 and entering the well 10. The BOP 16 may have two ram blocks 20 attached to corresponding pistons 22. The pistons 22 move integrally with the ram blocks 20 along directions A and B to close the well 10.

A cut view of the BOP 16 that shows the ram blocks 20 is shown in FIG. 2. The ram blocks 20 are shown moving inside a cavity 24. The cavity 24 may be bordered by a top seat 26 and a wear plate 28. The part of cavity 24 bordered by the top seat 26 and the wear plate 28 may contact the ram blocks 20 tighter than the remainder of the cavity 24. The ram blocks 20 may include a packer 30 (which may be an elastomer) and a top seal 31, which seals the well 10 when the ram blocks 20 are closed.

Given this arrangement of the BOP 16 and the fact that the weight of the ram block 20 may be substantial (in one application the weight may be about 200 Kg), the friction between the ram block 20 and a lower surface of the cavity 24 is high, producing a substantial amount of wear on the BOP 16, consequently deteriorating the sealing performance of the BOP 16. The noted wear has been observed, for example, in the wear plate 28, the upper seat 26, the cavity 24, etc. As a result of the wearing process, the affected elements of the BOP 16 have to be often changed/inspected such that the sealing capacity of the BOP is maintained. However, the maintenance and cost to replace these elements is high and thus, undesirable.

Accordingly, it would be desirable to provide systems and methods that maintain the sealing of the well with a low cost, low downtime operation, and also avoid the above noted shortcomings.

SUMMARY

According to one exemplary embodiment, there is a blowout preventer for sealing a well. The blowout preventer includes a body including a cavity having first and second recesses; a ram block configured to move inside the cavity; a top seat provided in the first recess and configured to seal the well when the ram block is closed; a wear plate provided in the second recess and configured to contact the ram block when the ram block moves inside the cavity over the wear plate; and a biasing element provided inside the cavity and configured to apply a biasing force on at least one of the top seat, the ram block or the wear plate to increase the sealing of the well.

According to another exemplary embodiment, there is a method for sealing a well with a blowout preventer that has a body with a cavity in which a ram block moves, the cavity having first and second recesses, a top seat being provided in the first recess and a wear plate being provided in the second recess. The method includes applying a pressure to move the ram block in the cavity of the blowout preventer; contacting the ram block with one of the top seat, the wear plate, or at least one pad, which is provided in a recess of the ram block, when sealing the well; and applying, with a biasing element provided inside the cavity, a biasing force to at least one of the top seat, the ram block or the wear plate to increase the sealing of the well.

According to another exemplary embodiment, there is a wireline blowout preventer for shearing a wireline that extends through the blowout preventer. The wireline blowout preventer includes a body including a cavity; a first ram block provided in the cavity and configured to move inside the cavity; a first shear blade connected to the first ram block and configured to shear the wireline; and a first biasing element provided between the first ram block and the first shear blade and configured to press the first shear blade towards a second shear blade attached to a second ram block. When the first ram block locks with the second ram block, the first shear blade slides over the second shear blade such that the first and second shear blades shear the wireline.

According to another exemplary embodiment, there is a method for shearing, with a wireline blowout preventer, a wireline that extends through the wireline blowout preventer. The method includes applying a pressure to a first ram block, which is provided in a cavity of a body of the wireline blowout preventer, to move the first ram block towards the wireline; applying a first biasing force with a first biasing element disposed between the first ram block and a first shear blade, which is connected to the first ram block, to press the first shear blade towards a second shear blade attached to a second ram block; and shearing the wireline when the first shear blade slides over the second shear blade.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of well sealing systems. However, the embodiments to be discussed next are not limited to these systems, but may be applied to other systems, i.e., BOP that have a moving element and/or a sealing element, or to a gate valve.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a biasing member or similar element may be added between a sealing element and a seal carrier to apply a substantially constant force on the sealing element regardless of a degree of weariness or manufacturing tolerance of the sealing element and/or the seal carrier. The biasing force applied on the carrier, opposite the sealing element, generates an almost constant load on the carrier and the sealing element. As the conventional ram BOP undertakes frequent replacements or repairs of the ram elastomer and worn surfaces (for example wear plate), the biasing force may be applied to at least one of the wear plate, ram block, top seat, or shear blade so that as the wear plate, ram block, top seat, top seal, or any other component wears out, for example, from abrasion, the compressive seal and/or blade loads remain substantially the same during the life time of these elements. The BOP elements mentioned above are next described in more detail with regard to FIGS. 3, 6, 11, and 14.

Figure 3:
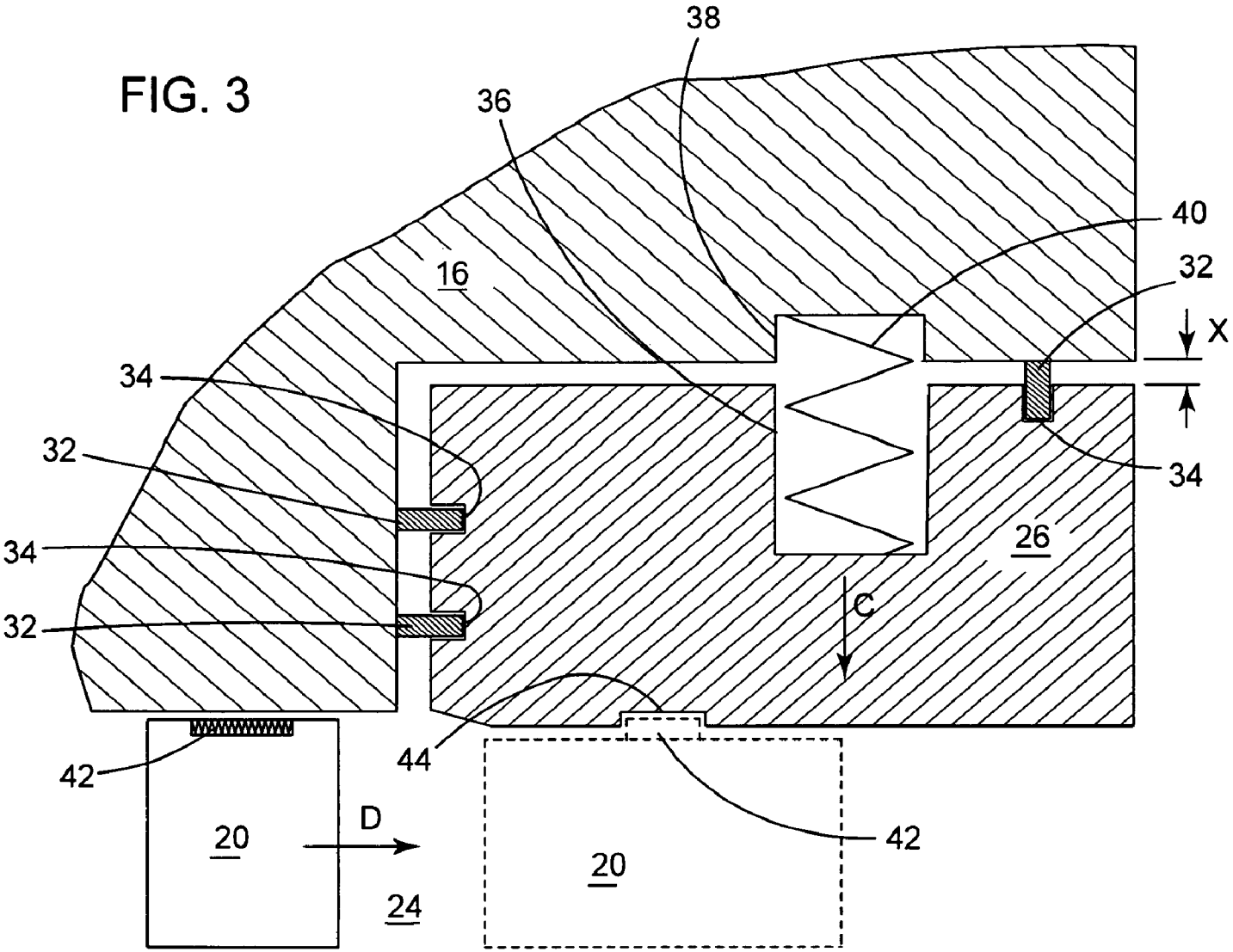
FIG. 3 is a schematic diagram of a BOP provided with a biasing element in a top seat according to an exemplary embodiment.

As illustrated in FIG. 3, a portion of the BOP 16 is shown together with the top seat 26. The top seat 26 is housed in a recess (a first recess) formed in the body of BOP 16. Various seals 32 may be provided in corresponding cavities 34, between the body of the BOP 16 and the top seat 26, for maintaining the sealing capability. The top seat 26 may be movably attached to the BOP 16 (as will be discussed later) for maintaining the top seat 26 attached to the body of the BOP 16. The top seat 26 is disposed inside the body of the BOP 16, to partially border cavity 24. The top seat 26 may include a cavity 36 that corresponds to a cavity 38 in the BOP 16. One or more biasing members 40 may be provided to extend in both cavities 36 and 38 such that a biasing force is applied to the top seat 26, to bias the top seat 26 away from the body of the BOP 16, towards cavity 24, as shown by arrow C in FIG. 3.

Figure 1:
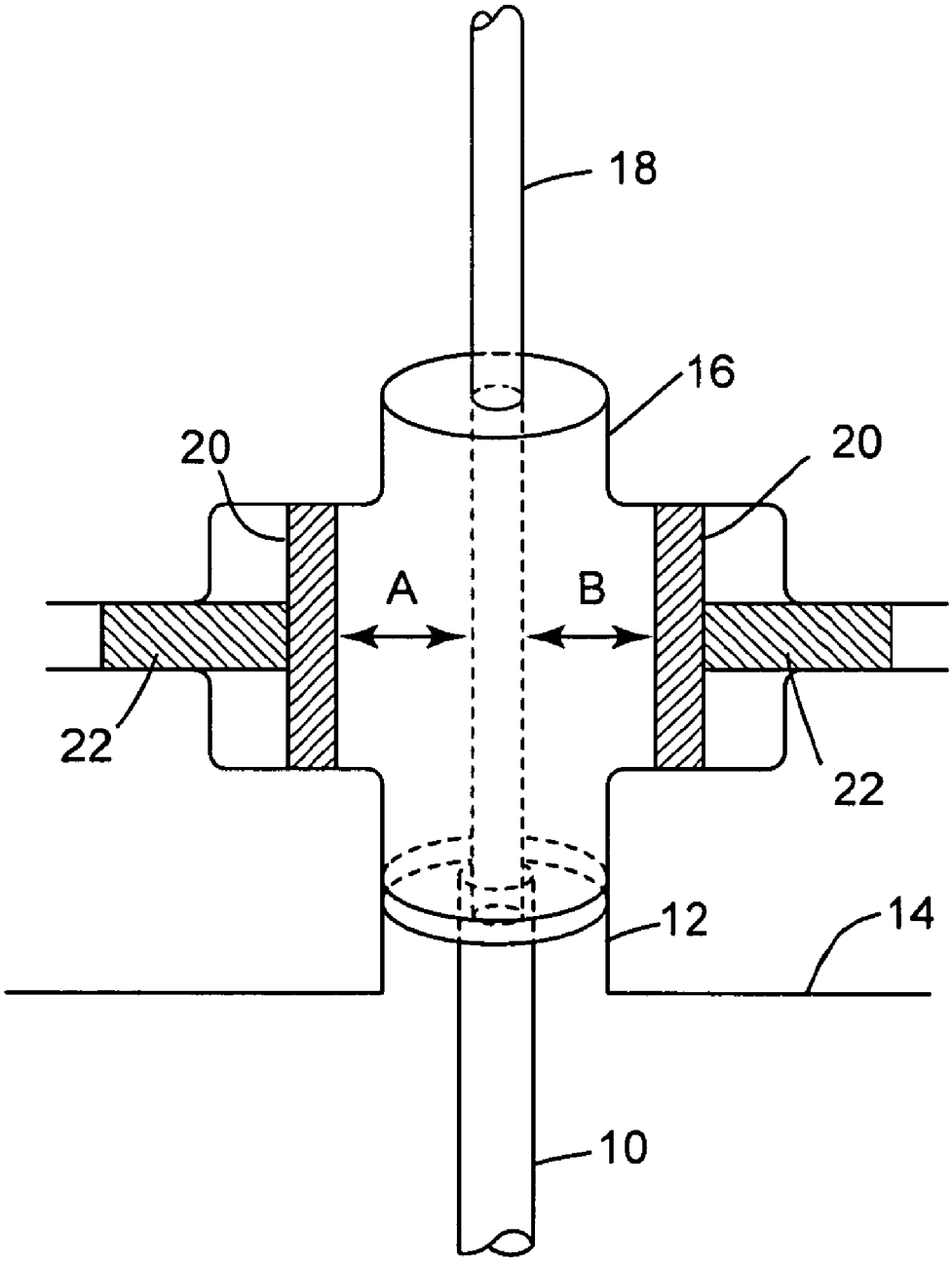
FIG. 1 Prior Art
FIG. 1 is a schematic diagram illustrating the BOP displaced on top of the well.

The biasing force may displace the top seat 26, away from the BOP 16, for example, by a distance (stroke) X as show in FIG. 3. When the ram block 20 moves as indicated by arrow D in FIG. 3 (for example due to a pressure applied on piston 22) to close the well 10, the ram block 20 moves towards the top seat 26 and presses against a lower surface of the top seat 26 because, in part, of the displacement X generated by the biasing element 40. A lower or upper surface is understood in the context of these embodiments relative to a position of the well 10 shown in FIG. 1. For clarity, a lower surface of the BOP faces the well and an upper surface of the BOP faces the surface of the sea when the BOP is not used in a test mode. Due to the applied biasing force, the contact between the top seat 26 and the ram block 20 is tightly maintained to preserve the sealing of the well. Even when the lower surface of the top seat 26 is worn, the tight contact between the ram block 20 and the top seat 26 is maintained due to the biasing force exerted by the biasing element 40. FIG. 3 also shows that a top seal 42, disposed on the ram block 20, may engage a receiving top seal cavity 44 on the top seat 26 when the ram block 20 is shut, to prevent leakage from the well 10.

Without the biasing element 40, the top seat 26 may not be tightly in contact with the ram block 20, especially after the ram block 20 has cycled for a number of times and the top seat 26, and/or the wear plate 28 and/or the ram block 20 are worn out. Therefore, according to this exemplary embodiment, a tight contact between the top seat 26 and the ram block 20 is achieved even when these elements have been repeatedly used and are worn.

Figure 4:
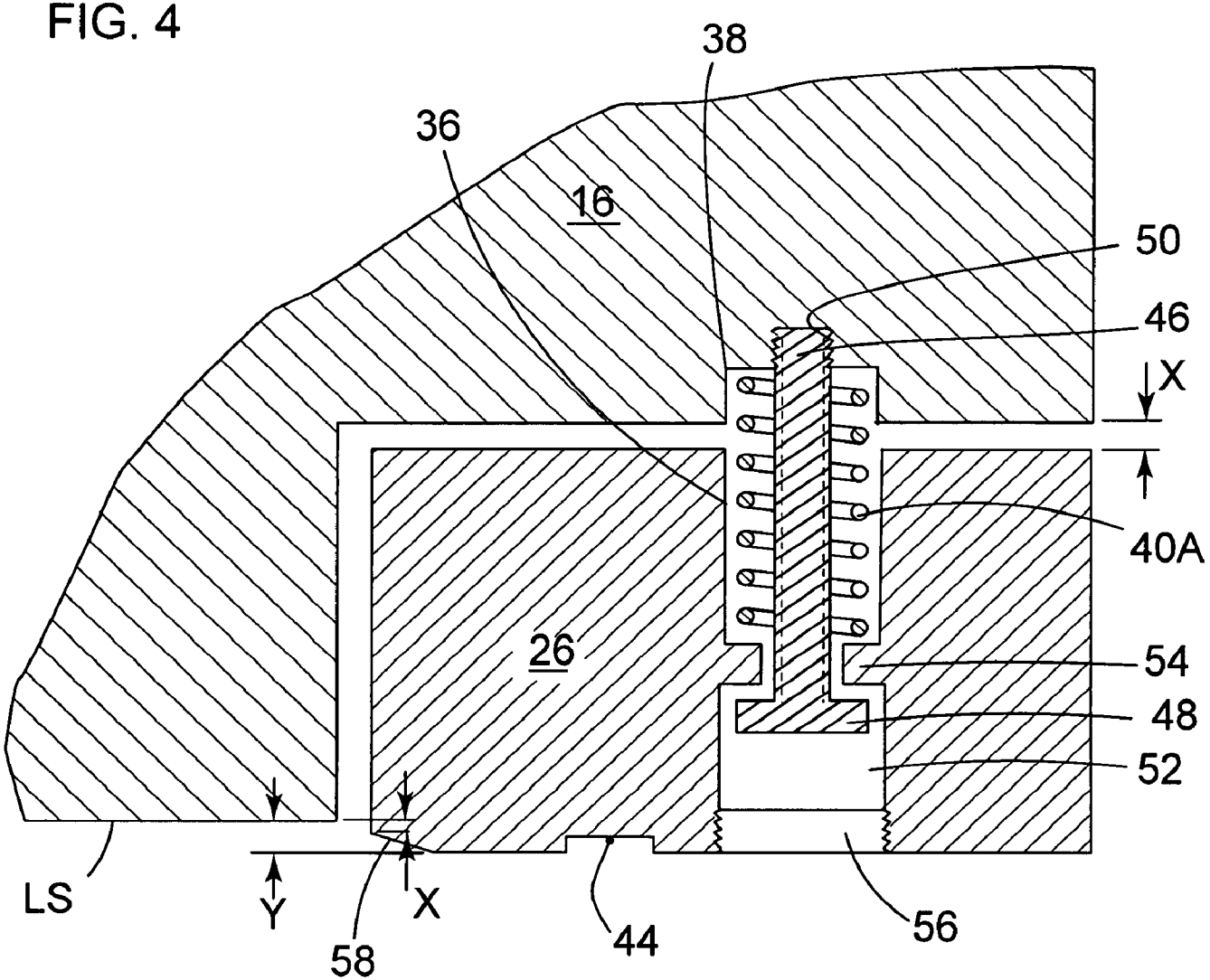
FIG. 4 is a schematic diagram illustrating a detailed view of the BOP of FIG. 3 according to an exemplary embodiment.

The biasing device 40 shown in FIG. 3 may include, according to an exemplary embodiment, at least one of one or more springs, a gas charged cylinder, a hydraulic element, a mechanical element, a magnetic device, or other devices known by those skilled in the art to produce a biasing force. The spring may be a coil spring or other types of springs. The biasing element 40 may have a size and spring constant k that may depend on the weight of the ram block, the pressure in the well, etc. According to an exemplary embodiment and as shown in FIG. 4, the biasing element 40 may include a coil spring 40A extending in cavities 36 and 38 of the top seat 26 and the BOP 16, respectively. An element 46 having a front end 48 and a rear end 50 may be provided, for example, inside the cavities 36 and 38. The rear end 50 of element 46 may be fixed to the body of the BOP 16 while the front end 48 may float in a chamber 52 that may be filled with a lubricant.

Thus, when the top seat 26 moves away from the body of the BOP 16, the movement of the top seat 26 is limited by the front end 48, i.e., portion 54 of the top seat 26 touches the front end 48 and stops the movement of the top seat 26. The chamber 52 may be provided with a plug 56, which may be opened for maintenance and/or replacing the lubricant. Element 46 may be encircled by the spring 40A to maintain the slidable connection of the top seat 26 with the BOP 16. One or more of such elements 46 may be provided between the top seat 26 and the BOP 16 to maintain the top seat 26 connected to the BOP 16.

Still with regard to FIG. 4, the biasing element 40 may determine a stroke X, i.e., a displacement of the top seat 26 relative to the BOP 16. The stroke X is also determined by a length of the element 46. More specifically, a distance of the front end 48 to the body of the BOP 16 determines the stroke X. According to an exemplary embodiment, this length may be adjusted by removing the plug 56 and, for example, screwing or unscrewing the element 46 such that the front end 48 moves closer or farther from the body of the BOP 16. This feature may be advantageous if the surface of the top seat 26 is still usable and maintains the sealing when in contact with the ram block but due to the wear of the lower surface of the top seat 26, the distance Y becomes too small to maintain the sealing capability. For this situation, instead of replacing the whole top seat 26, the element 46 may adjusted such that the distance of the front end 48 to the body of the BOP 16 is increased such that the original value of distance Y is reestablished.

The top seat 26 may also have a slanted (inclined) region 58 that is configured to achieve a smooth movement of the ram block 20 over the top seat 26.

Figure 5:
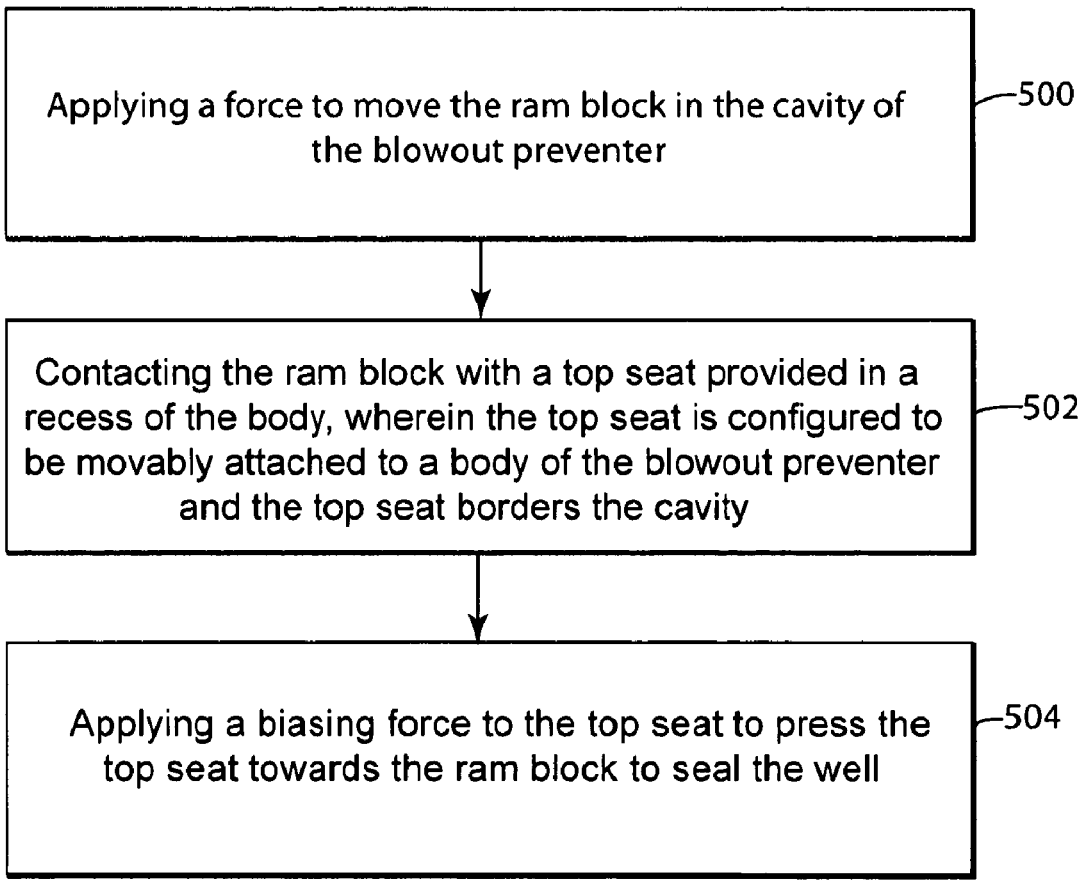
FIG. 5 is a flow chart illustrating steps for operating the BOP of FIG. 3 according to an exemplary embodiment.

According to an exemplary embodiment, the steps of a method for sealing a well with the blowout preventer discussed above are illustrated in FIG. 5. The method includes a step 500 of applying a force to move the ram block in the cavity of the blowout preventer, a step 502 of contacting the ram block with a top seat provided in a recess of a body of the BOP, where the top seat is configured to be movably attached to the body and the top seat borders the cavity, and a step 504 of applying a biasing force to the top seat with a biasing element provided between the top seat and the body, the biasing element being configured to press the top seat towards the ram block to seal the well.

Figure 2:
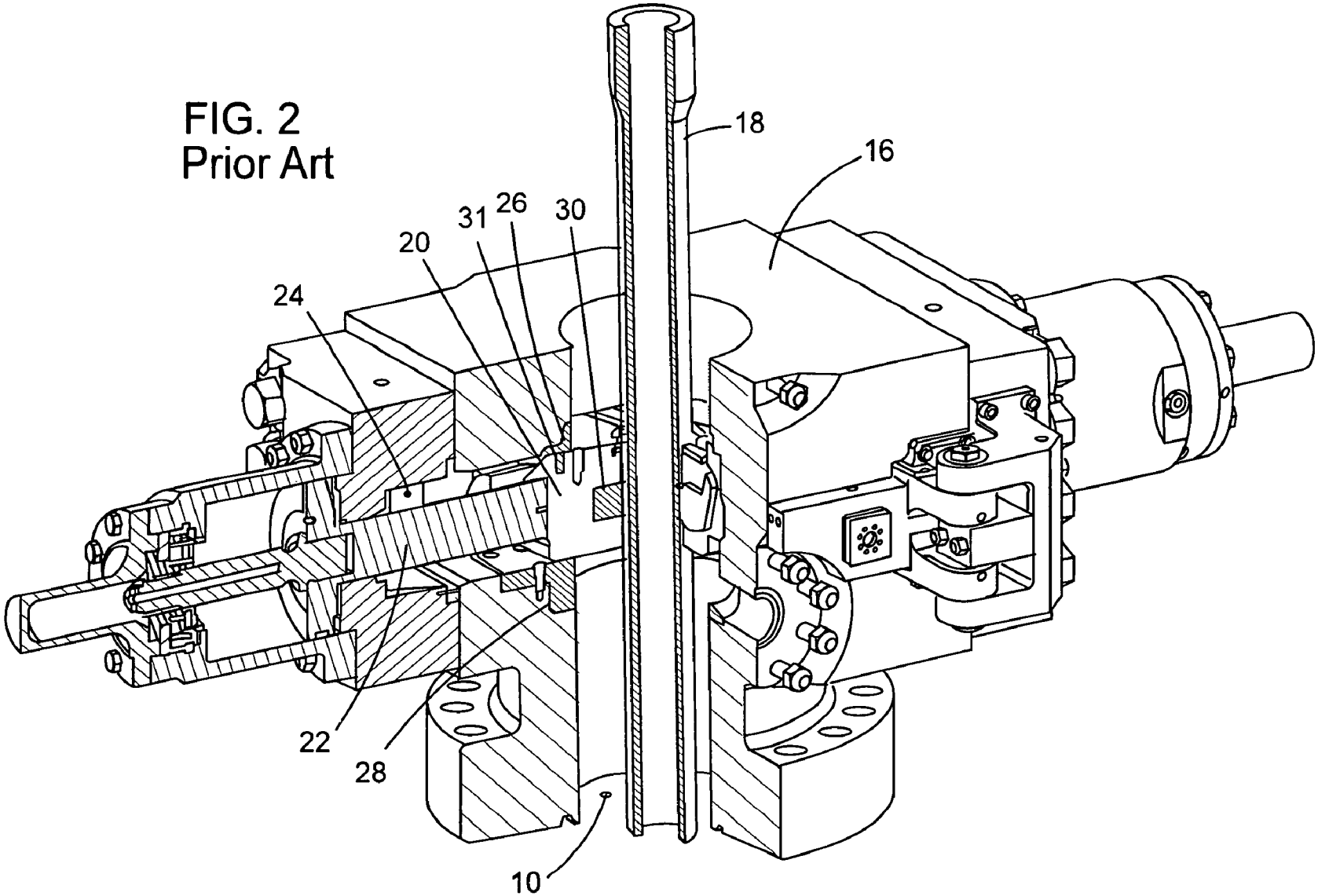
FIG. 2 Prior Art
FIG. 2 is a schematic diagram of a conventional BOP.
Figure 6:
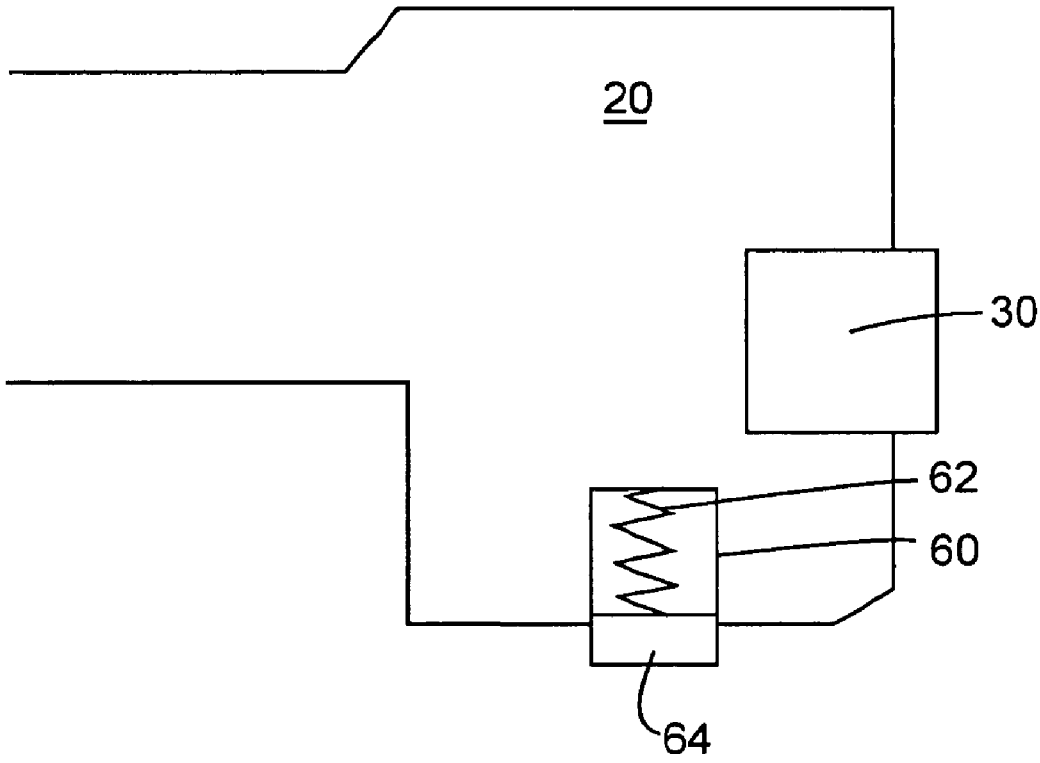
FIG. 6 is a schematic diagram of a ram block provided with a biasing element according to an exemplary embodiment.

According to another exemplary embodiment, which is shown in FIG. 6, the ram block 20 may have a cavity 60, on a lower part of the ram block, to include a biasing element 62 that presses at least one pad 64 towards the wear plate 28 of the BOP 16 shown in FIG. 2 or a lower surface of the cavity of the BOP 16. The biasing element 62 may be identical to biasing element 40 or may include different elements. The ram block 20 may have one or more cavities 60 including corresponding biasing elements 62 and pads 64. The pad 64 may help the ram block 20 to slide on the wear plate 28 of the BOP 16 when the ram block 20 is closing or opening. As the cavity 24 of the BOP 16 and/or the wear plate 28 experience high friction and/or abrasion due to the movement of the ram block 20, which, in one application, may have a weight of about 200 kg, the surfaces of the cavity 24 and wear plate 28 become worn and/or abrasive, degrading the sliding motion of the ram block 20. Thus, in order to maintain a tight fit between the ram block and the top seat or the ram block and the wear plate, the biasing force is applied by the biasing element 62 to the ram block to achieve the tight fit. The pad 64 may be made of Teflon, steel, ultra high molecular weight polyethylene and/or aramid.

Figure 7:
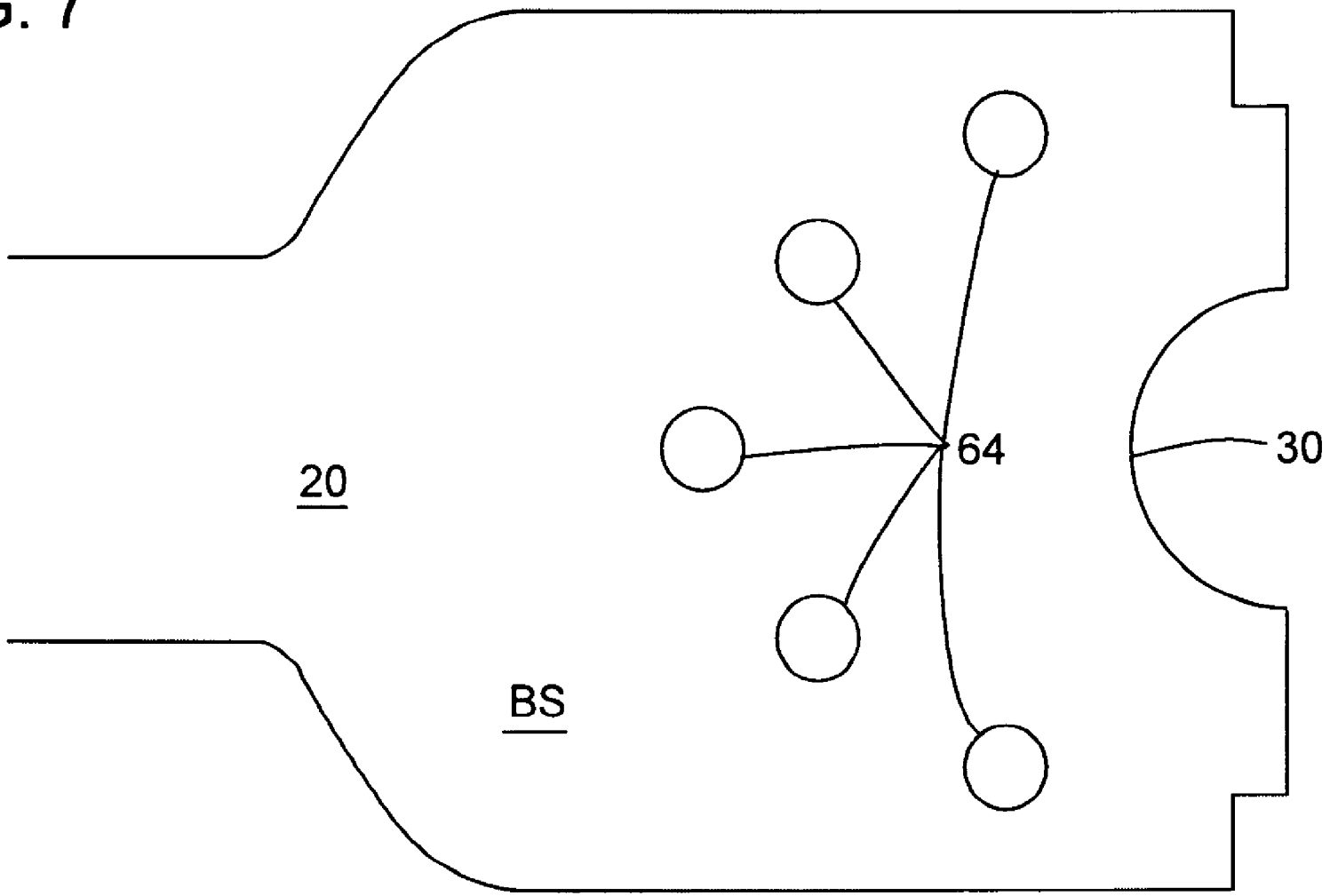
FIG. 7 is a schematic diagram illustrating a bottom surface of the biased ram block of FIG. 6 according to an exemplary embodiment.

By providing one or more pads 64 that may maintain a substantially constant contact (in terms of friction) of the ram block 20 with the cavity 24 and the wear plate 28, due to the biasing force applied by the biasing element 62, the ram block 20 is able to slide substantially unaffected by the wear of the cavity 24 and/or the wear plate 28. The pad 64 may be coated with Teflon, Teflon impregnated with Al, Be, and other materials known in the art. Soft materials may be used to protect the ram from damage. According to an exemplary embodiment, FIG. 7 shows a bottom surface BS of the ram block 20 that includes five pads 64 and corresponding biasing elements 62 (not shown). The five pads and their disposition with respect to one another shown in FIG. 7 are exemplary and those skilled in the art would recognize that a different number of pads and different disposition patterns may be used depending on the size and weight of the ram blocks and other design considerations. The ram block 20 shown in the figures may be a blind ram, a shear ram, etc.

Figure 8:
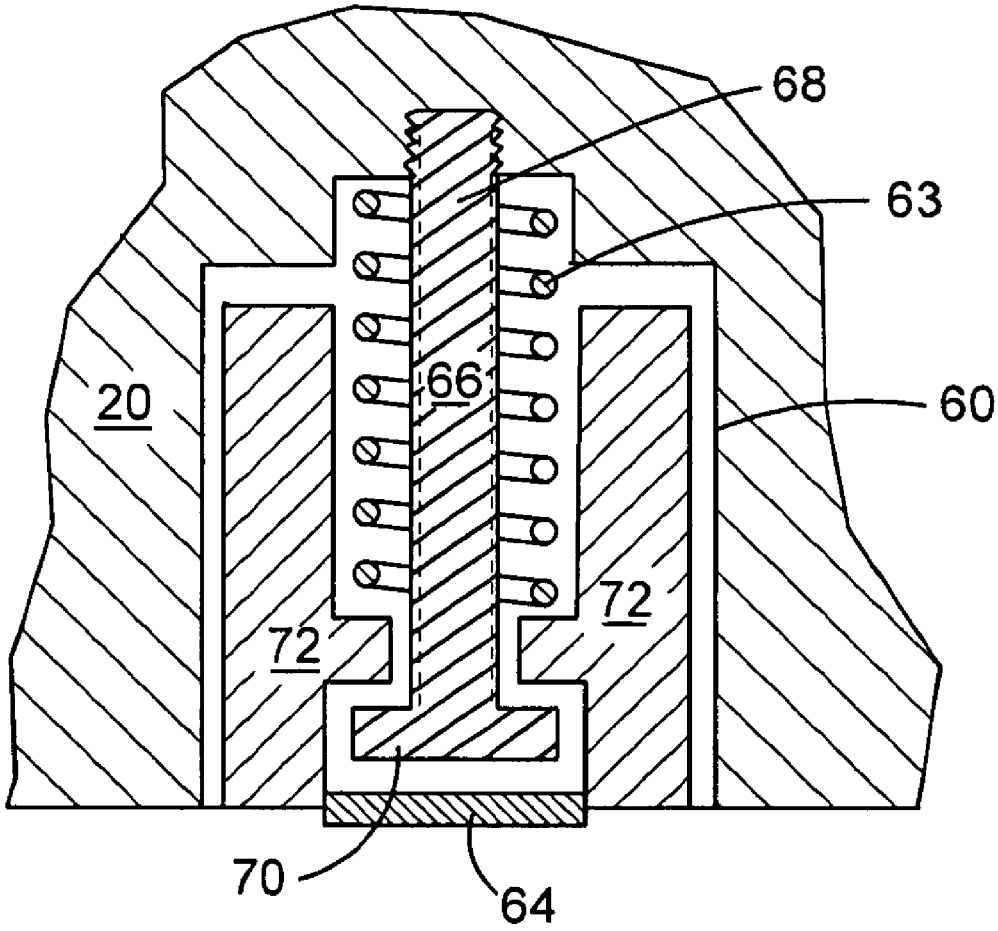
FIG. 8 is a schematic diagram illustrating the biasing element of the ram block of FIG. 6 according to an exemplary embodiment.

According to an exemplary embodiment, an arrangement of the biasing element 62 and pad 64 in cavity 60 is shown in FIG. 8. Other arrangements may be used as would be recognized by those skilled in the art in order to apply a biasing force to the pad 64. As shown in FIG. 8, the biasing element 62 (shown in FIG. 6) may include a support element 66 that has a rear end 68 fixedly attached to the ram block 20 and a front end 70. The front end 70 and the rear end 68 may function similar to the front end 48 and rear end 50 discussed with regard to FIG. 4. The pad 64 may include a supporting element (not shown), for example a cap that may be screwed into an element 72. The element 72 may partially enclose the spring 63 and moves together with the pad 64 under the biasing force applied by the biasing element 62. According to an exemplary embodiment, the features and advantages of the arrangement shown in FIG. 4 may be implemented in the configuration of FIG. 8. The biasing force generated by the spring 63 pushes away from the ram block the element 72 and the pad 64 such that the ram block 20 may maintain the tight fit with the other elements of the BOP.

The application of the biasing force by the biasing element 62 to the ram block 20 such that the ram block 20 seals the body of the BOP 16 is discussed next in the context of FIG. 2. When the ram block 20 seals the well 10, a pressure might build up in the well 10, below the ram block 20, which will eventually push the ram block 20 in an upwards direction in FIG. 2. Further, that pressure generated in the well would squeeze the top seal 31 to prevent an escape of the well pressure between the top surface of cavity 24 and the upper portion of the ram block 20. However, there may be a situation in which the ram block 20 is closed (i.e., touches the pipeline) but the pressure in the well is not enough to arm the top seal. In this case, the pressure in the well is escaping between the ram blocks 20 and the BOP 16 and thus the well is not sealed.

By providing the biasing force between the ram blocks 20 and the pad 64, the ram blocks 20 receive a supplemental force for squeezing the top seal 31, in addition to the force generated by the well pressure. Thus, the biasing force helps to squeeze the top seal 31 of the ram block 20, and to prevent malfunction of the BOP 16.

Figure 9:
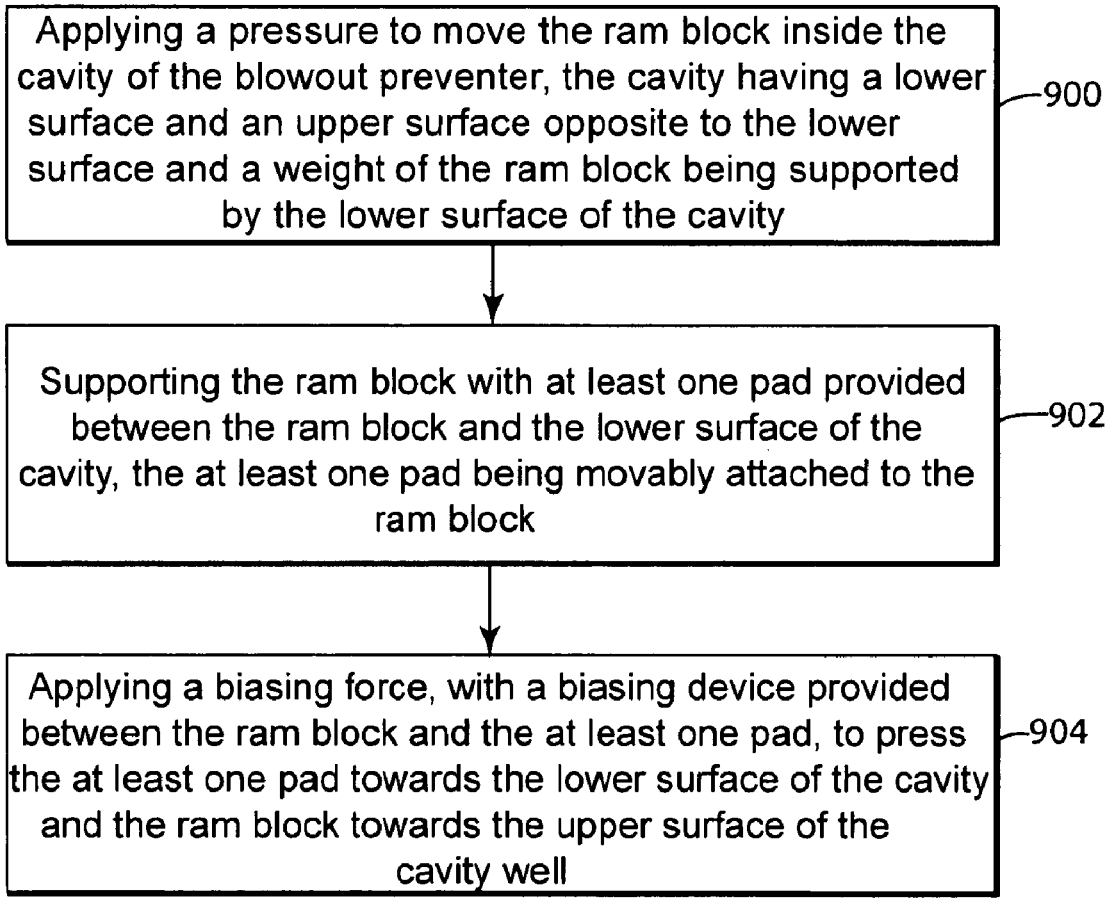
FIG. 9 is a flow chart illustrating steps of a method for using the biased ram block of FIG. 6 according to an exemplary embodiment.

According to an exemplary embodiment, steps of a method for sealing a well with a blowout preventer having a spring loaded ram block are illustrated in FIG. 9. The method includes a step 900 of applying a pressure to move the ram block inside the cavity of the blowout preventer, the cavity having a lower surface and an upper surface opposite to the lower surface and a weight of the ram block being supported by the lower surface of the cavity, a step 902 of supporting the ram block with at least one pad provided between the ram block and the lower surface of the cavity, the at least one pad being movably attached to the ram block, and a step 904 of applying a biasing force, with a biasing element provided between the ram block and the at least one pad, to press the at least one pad towards the lower surface of the cavity and the ram block towards the upper surface of the cavity to seal the well.

Figure 10:
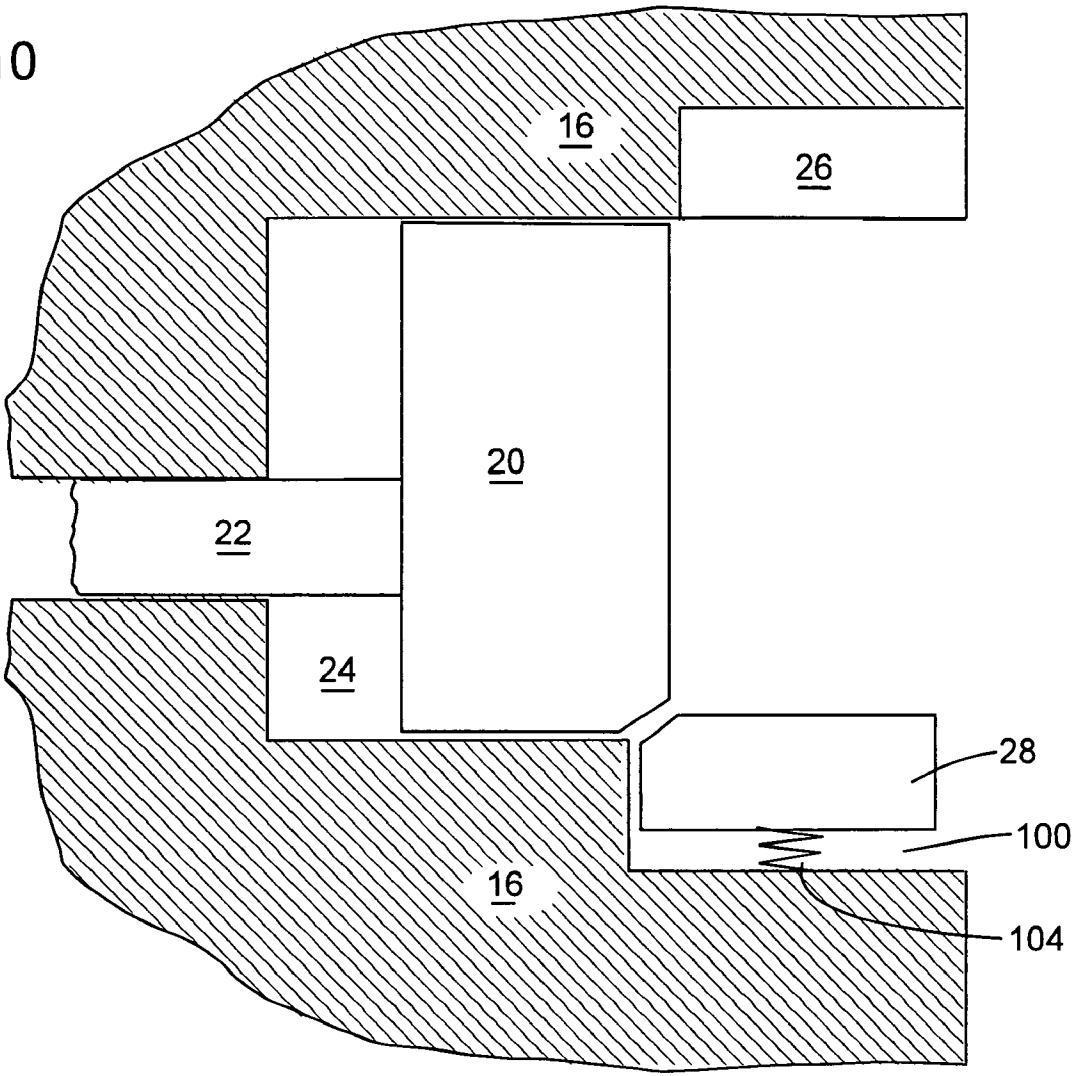
FIG. 10 is a schematic diagram of a wear plate provided with a biasing element according to an exemplary embodiment.

According to another exemplary embodiment, a biasing force may be applied between the body of the BOP and a wear plate that is tightly attached to the body of the BOP. As shown in FIG. 10, a low seat 100 may be a recess (second recess) formed in the cavity 24. The low seat 100 may be opposite to the top seat 26. However, the low seat 100 may be formed in the BOP 16 even if the top seat 26 is not present and the low seat 100 does not have to have the same shape, size or position as the top seat 26. The wear plate 28 is fixedly attached (by screws for example) to the low seat 100 in the conventional devices. However, according to this exemplary embodiment, the wear plate is movably attached to the BOP 16 such that a biasing element 104 is formed between the low seat 100 and wear plate 28. The wear plate 28 may be movably attached to the BOP 16, for example, using the arrangement shown in FIG. 4 (for example elements 46, 48, 50, 52, 54, and 56) or the arrangement shown in FIG. 8 (for example elements 66, 68, 70, and 72). Other arrangements are possible as would be recognized by those skilled in the art. For example, the dovetail mechanism may be used to hold the wear plate 28 while allowing it to be movable, or the wear plate 28 may be pressed in place with a snap ring.

By providing the biasing element 104 between the low seat 100 and the wear plate 28, the wear plate 28 may engage the ram block 20 more tightly when wear appears in at least one of the ram block 20 or the wear plate 28. Thus, the manufacturing tolerances for the ram block 20 and/or the wear plate 28 may be relaxed and also the lifespan of the wear plate 28 and/or the ram block 20 may be extended.

Figure 11:
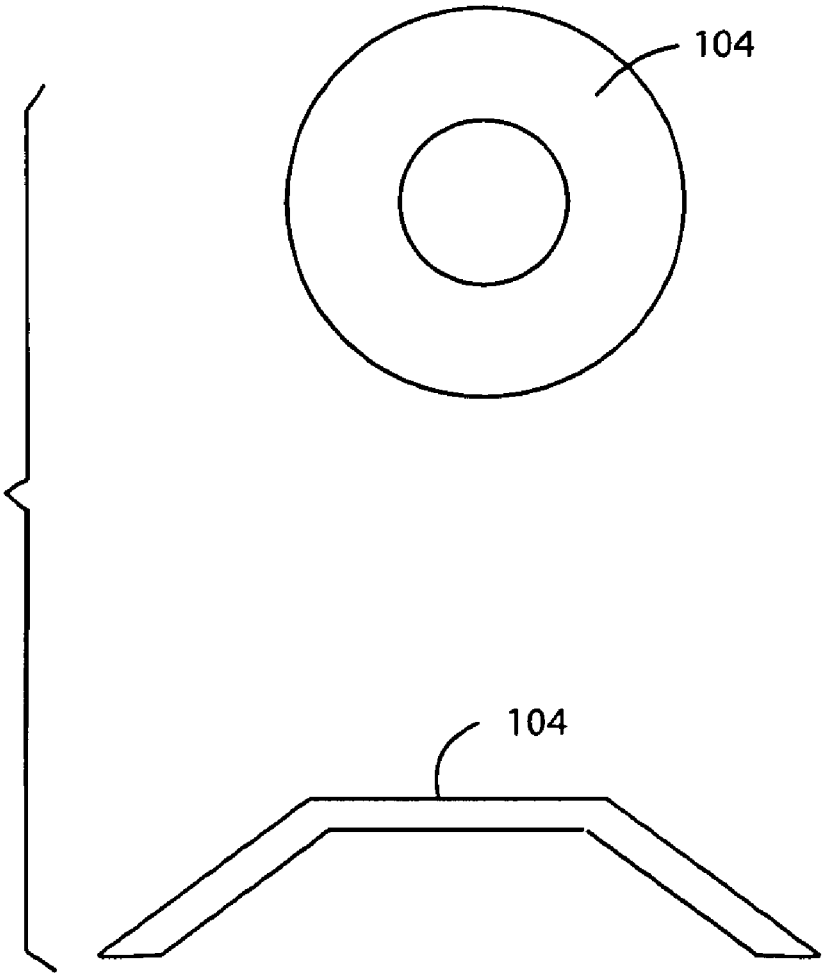
FIG. 11 is a schematic diagram of the biasing element attached to the wear plate of FIG. 10 according to an exemplary embodiment.

The biasing element 104 may be one of the biasing elements already discussed or may include a Belleville spring, which has a shape and profile as shown in FIG. 11. According to another exemplary embodiment, more than one biasing element 104 may be used between the low seat 100 and the wear plate 28. With regard to FIG. 10, both the ram block 20 and the wear plate 28 may have a slightly slanted surface such that the movement of the ram block 20 over the wear plate 28 is not jammed by their edges.

Figure 12:
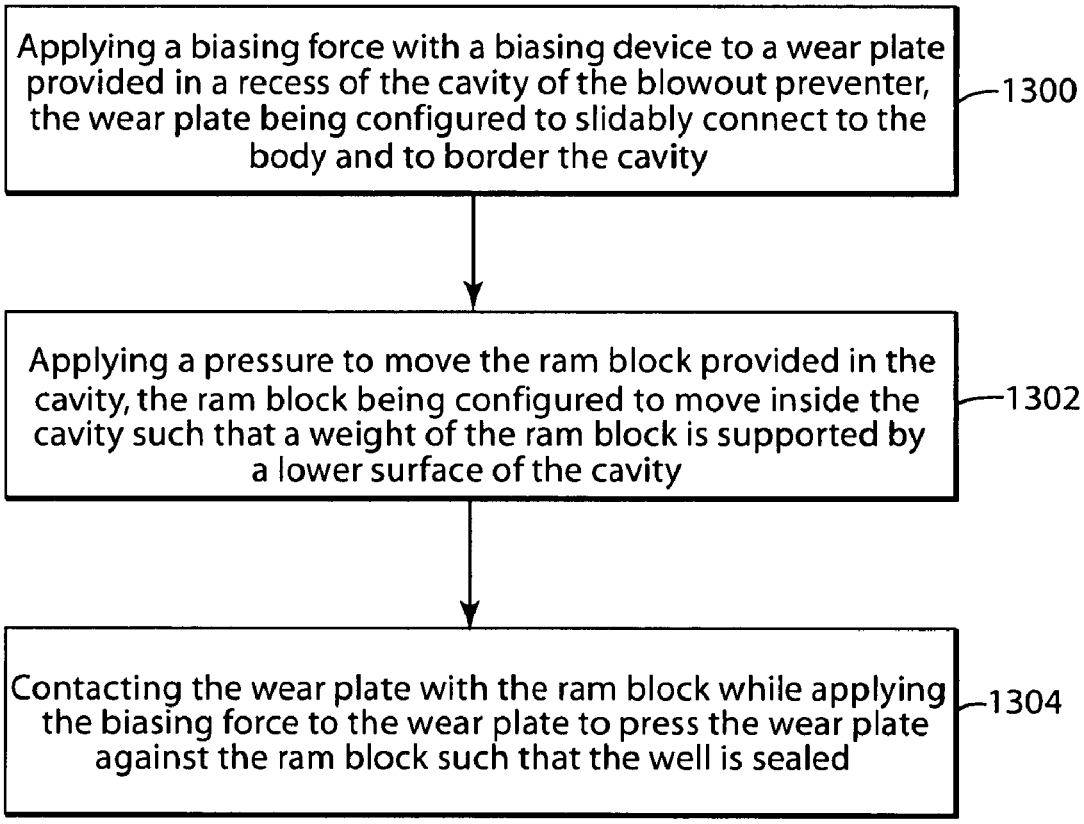
FIG. 12 is a flow chart illustrating steps for operating the BOP with the wear plate according to an exemplary embodiment.

According to an exemplary embodiment, the steps of a method for sealing a well with a blowout preventer that has a spring loaded wear plate are illustrated in FIG. 12. The method includes a step 1200 of applying a biasing force with a biasing element to a wear plate provided in a recess of the cavity of the blowout preventer, the wear plate being configured to movably connect to the body and to border the cavity, a step 1202 of applying a pressure to move the ram block in the cavity, the ram block being configured to move inside the cavity such that a weight of the ram block is supported by a lower surface of the cavity, and a step 1204 of contacting the wear plate with the ram block while applying the biasing force to the wear plate to press the wear plate against the ram block for arming the BOP.

Figure 13:
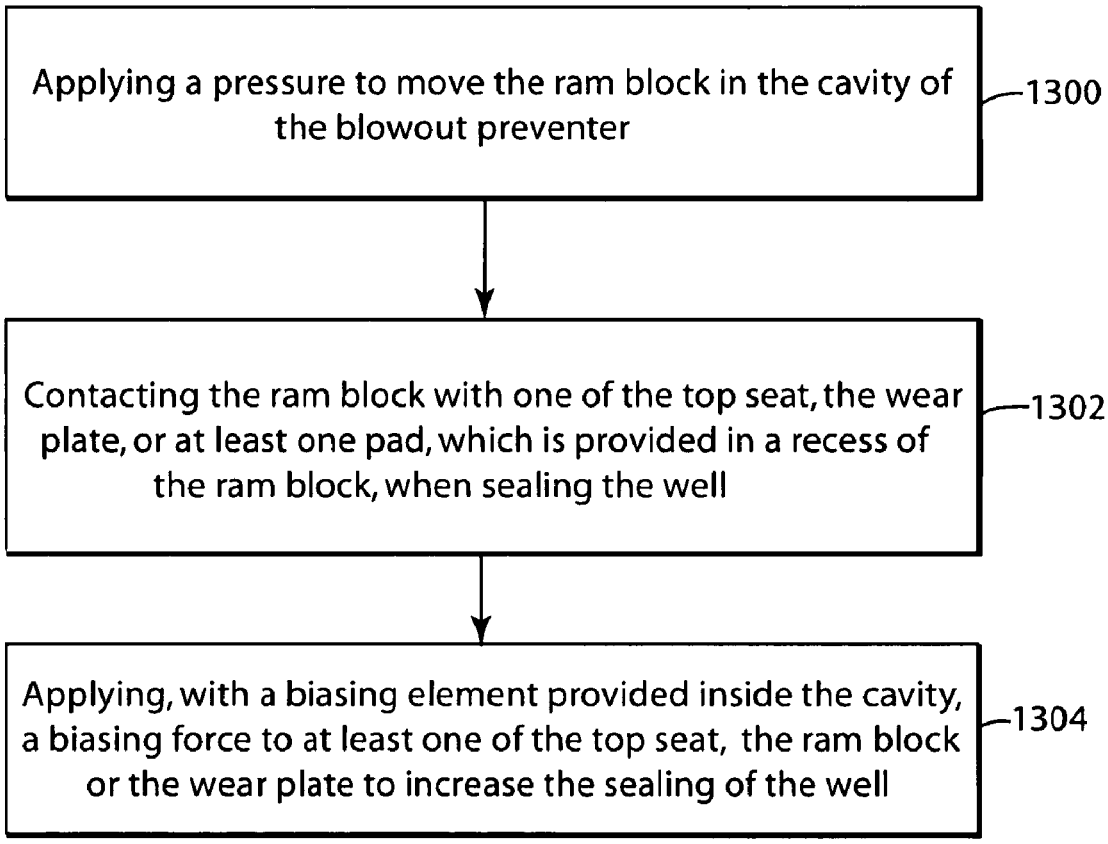
FIG. 13 is a flow chart illustrating steps for operating a BOP with a biasing element according to an exemplary embodiment.

According to an exemplary embodiment, a method for applying a biasing force to a BOP is discussed with regard to FIG. 13. The method for sealing a well uses a blowout preventer that has a body with a cavity in which a ram block moves, the cavity having first and second recesses, a top seat being provided in the first recess and a wear plate being provided in the second recess. The method includes a step 1300 of applying a pressure to move the ram block in the cavity of the blowout preventer, a step 1302 of contacting the ram block with one of the top seat, the wear plate, or at least one pad provided in a recess of the ram block when sealing the well, and a step 1304 of applying with a biasing element a biasing force to one of the top seat, the ram block or the wear plate to increase the sealing of the well.

Another type of ram device is discussed next. This ram is a wireline ram device that may be used not to shear the drill line but a wireline or other thin equipment (thinner than a pipeline) used by the operator inside the well. The term wireline is used herein to refer to a communication cord or a power cord for providing information and/or power to a device that might be lowered into the well. A wireline may be formed of plural braided steel strands to form a cable. The wireline is different from the pipeline. A force needed to shear the wireline is thus less than a force needed to shear the pipeline. However, the numerous independent strands tend to lay between conventional shearing equipment, thus making difficult for that equipment a clean cut. The wireline ram may be used after the well has been drilled and the drill pipe has been removed. In this case, the wireline is extending through the BOP into the well.

In case that the well needs to be closed, the wirelines need to be cut. Because the wireline may be made out of a plurality of strands, cutting the wireline may be difficult. Existing wireline rams include opposite blades that are moved towards each other for cutting the wireline. In many cases, and especially after repeated use of the blades, a gap appears between the blades when the rams are closed. Thus, existing wireline rams fail to completely cut the wireline after a certain usage time and the gap between the blades of the rams may prevent the complete separation of the wireline above and below the BOP.

Figure 14:
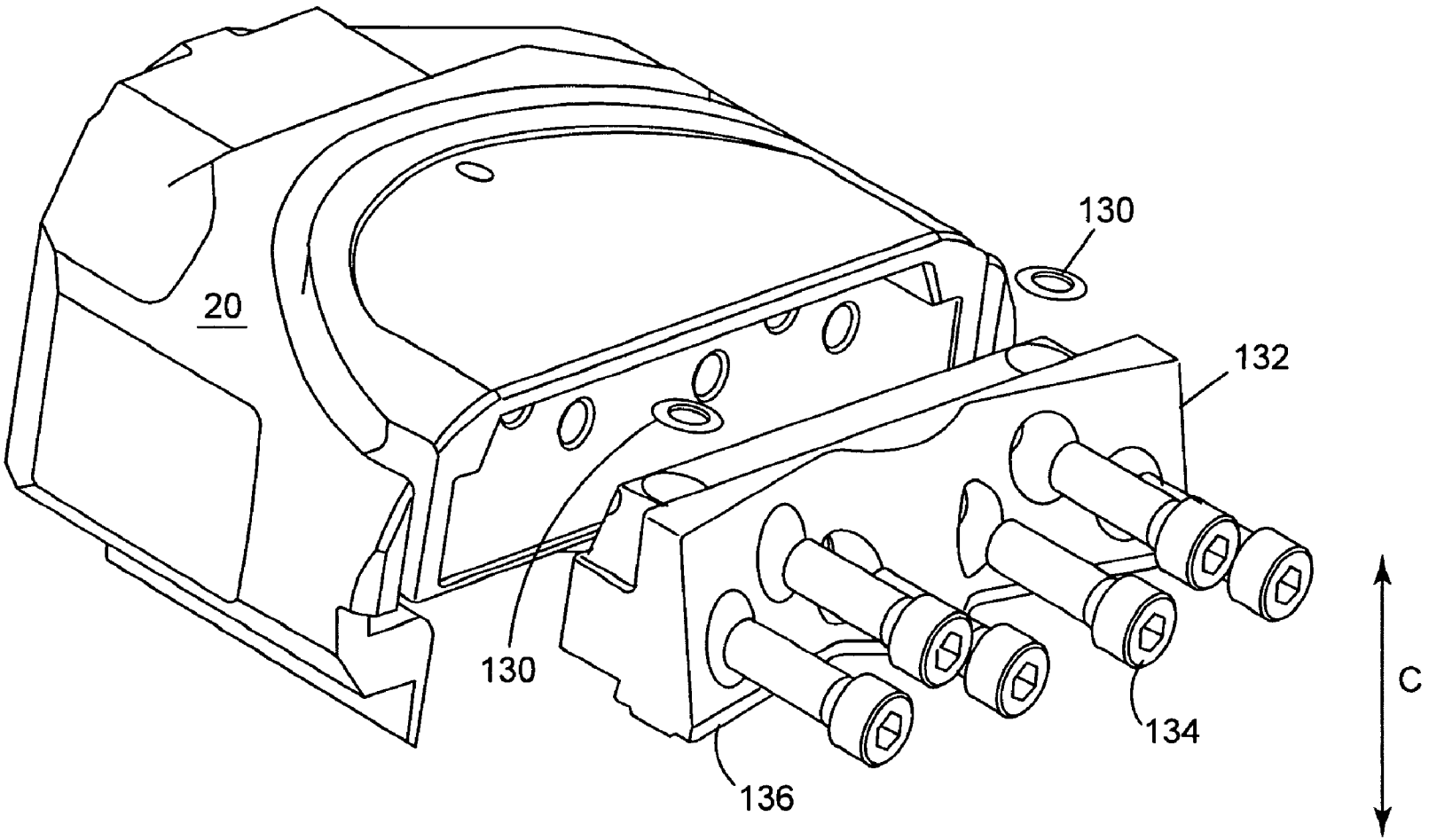
FIG. 14 is a schematic diagram of a wireline ram device provided with a biasing element according to an exemplary embodiment.

According to an exemplary embodiment, at least one blade of the BOP assembly may be provided with a biasing element, which may include a spring or belleville spring for reducing the possible gap between the blades of the wireline rams. As shown in FIG. 14, the biasing element 130 may be placed between the ram block 20 and the shear blade 132. FIG. 14 shows the shear blade 132 detached from the ram block 20 for a better understanding of the positioning of the biasing element 130. However, when the BOP is functional, the shear blade 132 is attached to the ram block 20, for example by screws 134. More than one biasing element 130 may be used and FIG. 14 shows two such biasing elements. By providing the biasing element 130 between the ram block 20 and the shear blade 132, the actual blade 136, which performs the cutting of the wireline, is pressed by the biasing force towards the other blade (not shown), thus reducing the potential gap between the shear blades.

The presence of the biasing element 130 may apply a force to the shear blade that in turn applies a load to the lateral T-seal (not shown), which is behind the blade and seals off the cavity 24 of the ram BOP 16. This seal is thus forced toward its mating surface on the other ram block allowing for improved sealing as the cavity wears or the seal fatigues.

Figure 15:
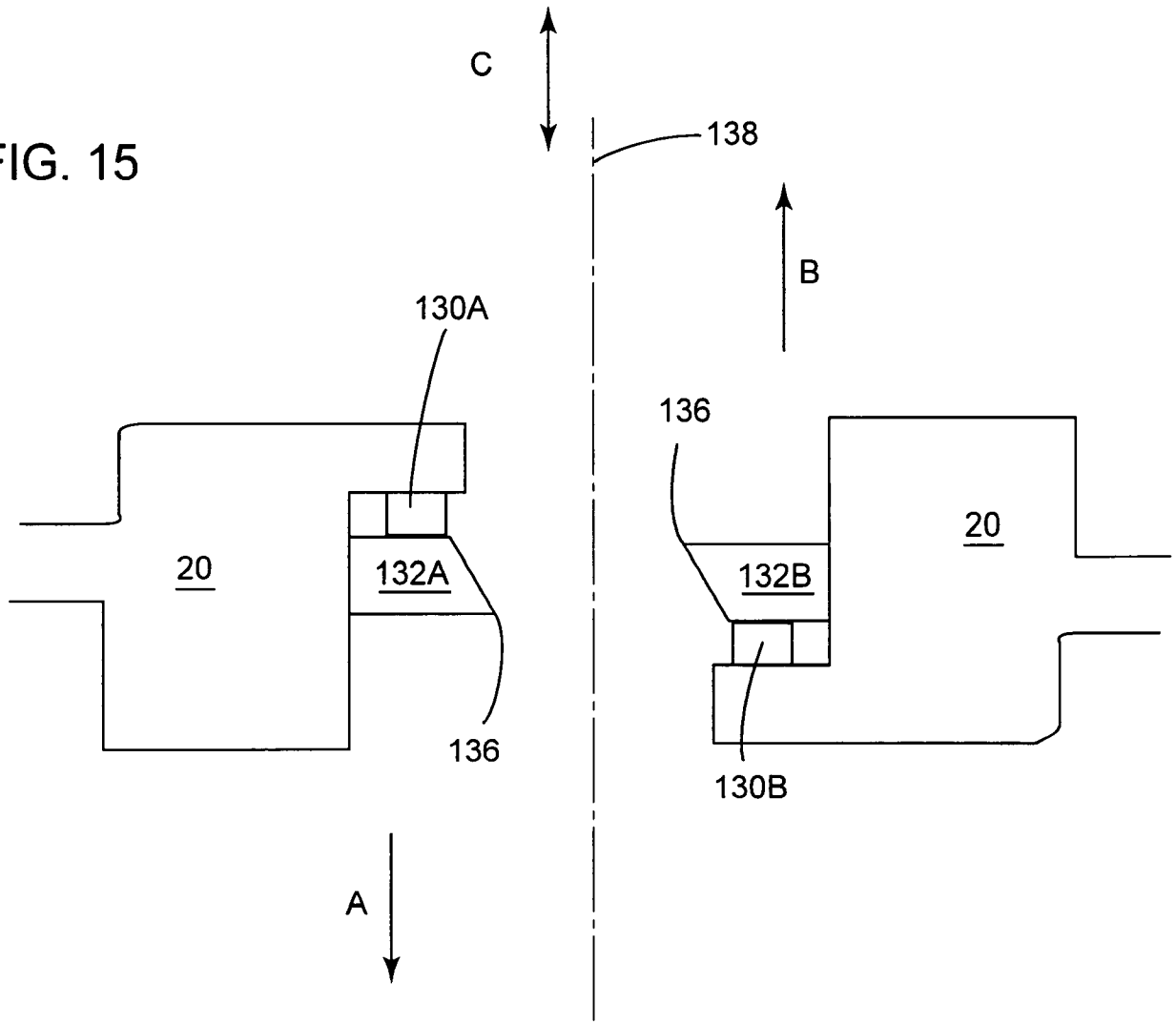
FIG. 15 is a schematic diagram showing how a biasing force produced by the biasing element is applied to various parts of the wireline ram device according to an exemplary embodiment.

FIG. 14 shows only one ram block 20 having the shear blade 132 provided on the upper part of the ram block while the other ram block (not shown) has a corresponding shear blade on the lower part of the ram block so that when the ram blocks are closed, the shear blades are displaced on top of each other. According to an exemplary embodiment shown in FIG. 15, a wireline blowout preventer may have a first biasing element 130A (spring coil, Belleville spring, etc.) configured to press the first shear blade 132A along a first direction A, substantially parallel with a wireline 138, and a second biasing element 130B configured to press the second shear blade 132B along a second direction B, substantially opposite to the first direction A. The wireline 138 substantially extends along direction C as shown in FIGS. 14 and 15.

Figure 16:
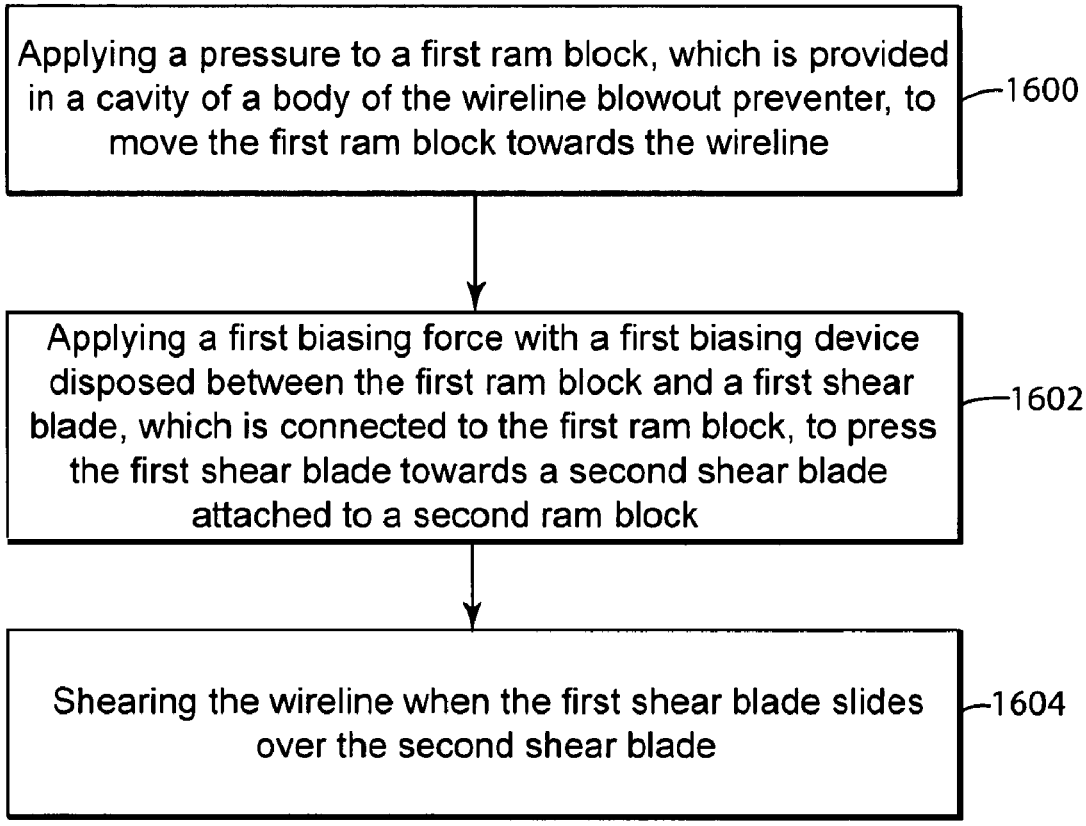
FIG. 16 is a flow chart illustrating steps for operating a wireline ram device according to an exemplary embodiment.

According to an exemplary embodiment, steps of a method for shearing a wireline with a wireline blowout preventer are illustrated in FIG. 16. The method includes a step 1600 of applying a pressure to a first ram block, which is provided in a cavity of a body of the wireline blowout preventer, to move the first ram block towards the wireline, a step 1602 of applying a first biasing force with a first biasing element disposed between the first ram block and a first shear blade, which is connected to the first ram block, to press the first shear blade towards a second shear blade attached to a second ram block, and a step 1604 of shearing the wireline when the first shear blade slides over the second shear blade.

According to another exemplary embodiment, any combination of the biasing elements discussed above may by applied simultaneously in the same BOP, i.e., between the top seat and the body, between the ram block and the pad, between the body and the wear plate, and between the ram block and the shear blade (when a wireline ram is used). According to another exemplary embodiment, the combination of of biasing elements or only one biasing element may be applied between some of the top seat and the body, the ram block and the pad, and/or the body and the wear plate.

Although the features and elements of the present exemplary embodiments are described in the embodiments in particular combinations, each feature or element can be used alone without the other features and elements of the embodiments or in various combinations with or without other features and elements disclosed herein. The methods or flow charts provided in the present application may be implemented in a computer program, software, or firmware tangibly embodied in a computer-readable storage medium for execution by a specifically programmed computer or processor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A blowout preventer comprising:

a body including a cavity having first and second recesses;

a ram block configured to move inside the cavity;

a top seat provided in the first recess and configured to seal the well when the ram block is closed;

a wear plate provided in the second recess and configured to contact the ram block when the ram block moves inside the cavity over the wear plate; and a biasing element provided inside the cavity and configured to apply a biasing force on at least one of the top seat, the ram block or the wear plate to increase the sealing of the well; and at least one pad movably attached to the ram block and configured to support a weight of the ram block on a lower surface of the cavity, wherein the biasing element includes a first part that is provided between the ram block and the at least one pad and configured to apply the biasing force on the at least one pad such that the at least one pad is pressed towards a lower surface of the cavity and the ram block is pressed towards an upper surface of the cavity.

2. The blowout preventer of claim 1, wherein the top seat is configured to be movably attached to the body and a second part of the biasing element is provided between the top seat and the body and is configured to apply the biasing force on the top seat such that the top seat is pressed towards the ram block to seal the well when the ram block is closed.

3. The blowout preventer of claim 2, wherein the second part of the biasing element is provided in a third recess of the body and a cavity of the top seat.

4. The blowout preventer of claim 2, wherein a lower surface of the top seat protrudes from an upper surface of the cavity.

5. The blowout preventer of claim 2, further comprising:

an adjustable element within the biasing element to adjust a stroke of the top seat relative to the body.

6. The blowout preventer of claim 1, further comprising:

an adjustable element within the biasing element to adjust a stroke of the at least one pad relative to the ram block.

7. The blowout preventer of claim 1, wherein a surface of the at least one pad that contacts the lower surface of the cavity protrudes from a lower surface of the ram block.

8. The blowout preventer of claim 1, wherein the wear plate is configured to movably connect to the body, and the biasing element has a third part that is provided between the wear plate and the body and is configured to apply the biasing force to the wear plate to press the wear plate towards the ram block when the ram block is closed.

9. The blowout preventer of claim 8, wherein an upper surface of the wear plate that contacts a lower surface of the ram block protrudes from a lower surface of the cavity when the wear plate is not in contact with the ram block.

10. The blowout preventer of claim 8, further comprising:

an adjustable element within the biasing element to adjust a stroke of the wear plate relative to the body.

11. The blowout preventer of claim 1, wherein the biasing element comprises at least one of a coil spring, plural coil springs, a Belleville spring, plural Belleville springs, a dovetail mechanism, a gas charged cylinder, a magnetic device, a mechanical device or a combination thereof.

12. A blowout preventer comprising:

a body including a cavity having first and second recesses;

a ram block configured to move inside the cavity;

a top seat provided in the first recess and configured to seal the well when the ram block is closed;

a wear plate provided in the second recess and configured to contact the ram block when the ram block moves inside the cavity over the wear plate; and a biasing element provided inside the cavity and configured to apply a biasing force on at least one of the top seat, the ram block or the wear plate to increase the sealing of the well, wherein the biasing element is a first biasing element provided between the body and the top seat and the blowout preventer further comprises a second biasing element provided between the ram block and at least one pad, and a third biasing element provided between the body and the wear plate.

13. A method for sealing a well with a blowout preventer that has a body with a cavity in which a ram block moves, the cavity having first and second recesses, a top seat being provided in the first recess and a wear plate being provided in the second recess, the method comprising:

applying a pressure to move the ram block in the cavity of the blowout preventer;

contacting the ram block with one of the top seat, the wear plate, or at least one pad, which is provided in a recess of the ram block, when sealing the well;

applying, with a biasing element provided inside the cavity, a biasing force to at least one of the top seat, the ram block or the wear plate to increase the sealing of the well; and supporting a weight of the ram block on a lower surface of the cavity with at least one pad movably attached to the ram block, wherein a first part of the biasing element is provided between the ram block and the at least one pad and configured to apply the biasing force on the at least one pad such that the at least one pad is pressed towards a lower surface of the cavity and the ram block is pressed towards an upper surface of the cavity.

14. The method of claim 13, wherein the top seat is configured to be movably attached to the body and a second part of the biasing element is provided between the top seat and the body and is configured to apply the biasing force on the top seat such that the top seat is pressed towards the ram block to seal the well when the ram block is closed.

15. The method of claim 14, wherein the second part of the biasing element is provided in a third recess of the body and a cavity of the top seat.

16. The method of claim 14, wherein a lower surface of the top seat is pressed further down from an upper surface of the cavity.

17. The method of claim 14, further comprising:

adjusting, with an adjustable element within the biasing element, a stroke of the top seat relative to the body.

18. The method of claim 13, further comprising:

adjusting, with an adjustable element within the biasing element, a stroke of the at least one pad relative to the ram block.

19. The method of claim 13, wherein a surface of the at least one pad that contacts the lower surface of the cavity is pressed farther down from a lower surface of the ram block.

20. The method of claim 13, wherein the wear plate is configured to movably connect to the body, and a third part of the biasing element is provided between the wear plate and the body and is configured to apply the biasing force to the wear plate to press the wear plate towards the ram block to seal the well when the ram block is closed.

21. The method of claim 20, wherein an upper surface of the wear plate that contacts a lower surface of the ram block extends higher than a lower surface of the cavity when the wear plate is not in contact with the ram block.

22. The method of claim 20, further comprising:

adjusting, with an adjustable element within the biasing element, a stroke of the wear plate relative to the body.

23. The method of claim 13, wherein the biasing element comprises at least one of a coil spring, plural coil springs, a Belleville spring, plural Belleville springs, a gas charged cylinder, a magnetic device, a mechanical device, and a combination thereof.

* * * * *